US010603905B2

(12) United States Patent
Huijbers et al.

(10) Patent No.: US 10,603,905 B2
(45) Date of Patent: Mar. 31, 2020

(54) METHOD OF PRINTING

(71) Applicant: Océ Holding B.V., Venlo (NL)

(72) Inventors: Jeroen P. J. Huijbers, Venlo (NL); Albertine P. Wijnheijmer, Venlo (NL); Hendricus F. M. Jeurissen, Venlo (NL); Ronnie J. H. G. Berghs, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/120,695

(22) Filed: Sep. 4, 2018

(65) Prior Publication Data

US 2018/0370225 A1 Dec. 27, 2018

Related U.S. Application Data

(63) Continuation of application No. PCT/EP2017/058959, filed on Apr. 13, 2017.

(30) Foreign Application Priority Data

Apr. 14, 2016 (EP) ..... 16165428

(51) Int. Cl.
*B41J 2/045* (2006.01)
*B41J 11/00* (2006.01)

(52) U.S. Cl.
CPC ..... *B41J 2/04566* (2013.01); *B41J 11/002* (2013.01); *B41J 11/0015* (2013.01)

(58) Field of Classification Search
CPC .... B41J 2/04566; B41J 11/0015; B41J 11/002
See application file for complete search history.

(56) References Cited

U.S. PATENT DOCUMENTS

2011/0109710 A1 5/2011 Miyakoshi et al.
2011/0310202 A1* 12/2011 Kojima ..... B41J 2/165 347/100

FOREIGN PATENT DOCUMENTS

JP 2009-184165 A 8/2009

OTHER PUBLICATIONS

European Search Report for EP 16165428 dated Sep. 22, 2016.
International Search Report for PCT/EP2017/058959 dated Jun. 29, 2017.
Written Opinion of the International Searching Authority for PCT/EP2017/058959 dated Jun. 29, 2017.

* cited by examiner

*Primary Examiner* — Julian D Huffman
(74) *Attorney, Agent, or Firm* — Birch, Stewart, Kolasch & Birch, LLP

(57) ABSTRACT

A printing system and method for improving ink absorption in a print substrate by preventing evaporation includes a conditioned transport module arranged for transporting a printed print substrate from a (conditioned) image formation module to a drying/fixation module. The transport module includes a control system configured for controlling the relative humidity inside the transport module to at least 50%.

9 Claims, 3 Drawing Sheets

METHOD OF PRINTING

CROSS-REFERENCE TO RELATED APPLICATIONS

This application is a Continuation of PCT International Application No. PCT/EP2017/058959, filed on Apr. 13, 2017, which claims priority under 35 U.S.C. § 119 to application Ser. No. 16/165,428.0, filed in Europe on Apr. 14, 2016. The entirety of each of the above-identified applications is expressly incorporated herein by reference.

BACKGROUND OF THE INVENTION

1. Field of the Invention

The present invention relates to a printing system and a method of printing for improving ink absorption in a porous print substrate.

2. Background of the Invention

Printing systems and methods comprising printing steps performed in a conditioned image formation module (e.g. temperature and relative humidity) and drying and/or fixating in a drying/fixation module arranged downstream of the conditioned image formation module are known in the art, for example in the Océ VarioPrint 1300 printing system. In such known printing systems, there is arranged a transporting mechanism for transporting printed print substrates from the image formation module to the drying/fixation module.

A disadvantage of such printing methods and systems is that at relatively high printing speeds (>200-400 A4 images per minute), printed matter with an inferior drying robustness is obtained, which is thought to be caused by limited absorption of ink compositions into the print substrates.

SUMMARY OF THE INVENTION

It is an object of the present invention to overcome or at least mitigate said disadvantage and provide a printing system and method wherein the absorption of ink compositions into the print substrate is improved, such that printed matter with an improved drying robustness at high printing speeds can be obtained.

This object can be obtained with a printing system comprising: an image formation module; a drying/fixation module; and a transport module arranged between the image formation module and the drying/fixation module for transporting a printed print substrate from the image formation module to the drying and fixing module, wherein the transport module comprises a control system configured for controlling the relative humidity inside the transport module to at least 50%, preferably between 50% and 100%, more preferably between 55% and 95%, more preferably between 60% and 90%.

In an embodiment, the control system arranged in the transport module comprises a relative humidity sensor (RH) and a mechanism for increasing the relative humidity (RH).

Examples of mechanisms for increasing relative humidity are known in the art and comprise: atomizers, evaporators, steam units and the like.

In an embodiment, the control system is configured for controlling the temperature, preferably in a range of between 40° C.-80° C., more preferably between 45° C. and 70° C., even more preferably between 50° C. and 60° C. The control system according to the present embodiment therefore comprises a temperature sensor and a heater and optionally a cooling device.

In a specific example, the temperature is controlled to 50° C.±2° C. and the relative humidity to at least 60% at that temperature.

Without wanting to be bound to any theory, it is believed that a low residual amount of liquid on the surface of print media before entering a drying/fixation stage is required to obtain an improved and optimal (drying) robustness.

The residual amount of liquid is a result of evaporation of solvents (including water) present in the ink composition and absorption of ink constituents in the print substrate, all within 100-1000 ms. After this period of time, the ink composition has attained a high viscosity due to evaporation, which limits or even prevents further absorption, such that the residual amount of liquid on the surface of the printed print substrate is too high to obtain a satisfactory (drying) robustness.

Therefore, in order to further reduce the residual amount of liquid on the surface of the print substrate before entering a drying/fixation stage, evaporation of ink components should be prevented, in order to moderate the viscosity increase and hence to promote absorption of ink components into the print substrate.

The present inventors have surprisingly found that preventing or mitigating evaporation during 100-2000 ms (a.o. dependent on media type) has a significant positive influence on the (drying) robustness of the printed matter.

The effect of the present invention can be further enhanced by using print substrates having high absorption characteristics and/or using an ink having a high absorption coefficient and/or a limited evaporation coefficient and/or an absorption coefficient that is less dependent on viscosity changes of the ink (e.g. due to evaporation) and/or using an ink that is less susceptible to viscosity increase upon evaporation.

In an embodiment, the transport module (10) comprises a transporting mechanism (11) providing a transport path having a length that satisfies the equation 1:

$$L \geq (v_{printing}/60 * t_{abs} * W_{image}) \qquad \text{equation 1}$$

wherein:

$v_{printing}$=the printing speed in images per minute (ipm);

$t_{abs}$=print substrate and ink set dependent absorption time (s);

$W_{image}$=image width (m).

In a worst case scenario (present invention), the absorption of the inks into the print substrate takes about 2000 ms and evaporation after image formation must be prevented for 2000 ms, in which an A4 width (i.e. 21 cm) is transported over a distance of [300 images/60 s*2000 ms*21 cm=] 2.1 m. Considering the paper transport path of a printer, the inventors have found that this is best realized by conditioning the space between the printing unit and the drying/fixation unit, wherein a media transport mechanism is arranged, i.e. a conditioned transport module.

In an embodiment, the transporting mechanism comprises at least one transporting mechanism selected from the group consisting of a transport belt, a transport roller and a transport drum.

In another aspect, the present invention pertains to a method of printing for improving ink absorption into a printed print substrate by preventing evaporation, the method comprising the steps of: printing an image on a print substrate; transporting the printed print substrate obtained in said step of printing; drying and/or fixating the image on the printed print substrate, wherein said step of transporting is performed in a conditioned environment having a relative humidity controlled to at least 50%, preferably between 50% and 100%, more preferably between 55% and 95%, more preferably between 60% and 90%.

In an embodiment, said step of transporting is performed in a conditioned environment, wherein the temperature is controlled, preferably in a range of between 40° C.-80° C., more preferably between 45° C. and 70° C., even more preferably between 50° C. and 60° C.

In a specific example, the temperature is controlled to 50° C.±2° C. and the relative humidity to at least 60% at that temperature.

In an embodiment, the relative humidity (RH) in said step of transporting is controlled to at least 70%.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
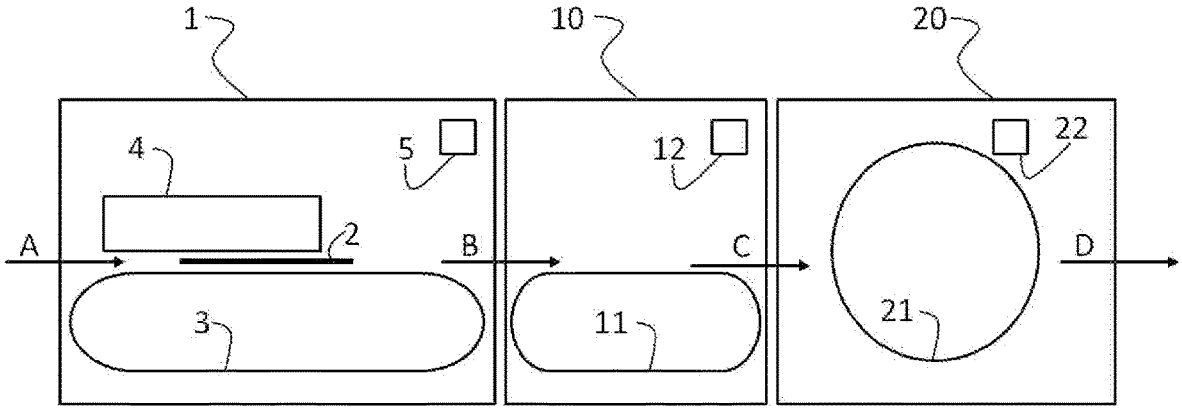
FIG. 1 is a schematic representation of an inkjet printing system according to the present invention.

The present invention will now be described with reference to the accompanying drawings, wherein the same or similar elements are identified with the same reference numeral.

FIG. 1 shows a printing system according to the present invention, comprising image formation module 1, a transport module 10 and a drying/fixation module 20.

The image formation module 1 comprises a transporting mechanism 3 arranged for transporting a print substrate 2 that has entered the printing module 1 (indicated with arrow A) underneath an image forming device 4 comprising ink jet print heads such that an image is printed on the printing substrate. The transporting mechanism 3 is illustrated as a belt, but could also be a drum of rollers. The image formation module further comprises a control system 5 for controlling environmental conditions inside the image formation module, for example temperature and (relative) humidity. By controlling a high (e.g. >70% RH) humidity, evaporation of ink is prevented or at least reduced.

The transport module 10 comprises a transporting mechanism 11 that is arranged and adapted for transporting the printed print substrate from the image formation module 1 to the drying/fixation module 20 (indicated with arrows B and C respectively). The length of the transport path along the transporting mechanism 11 is designed such that the residence time of a printed print substrate is long enough to promote absorption of the ink into the print substrate. Because the absorption is also dependent on the type of print substrate and used ink set, a desired media range and ink set has to be selected and the optimal length of the transport path along transporting mechanism 11 in the transport module has to be calculated. In the worst case scenario as described above, the minimum length of the transport path is 2.1 m. The transport module further comprises a control system 12 for controlling environmental conditions inside the transport module, for example temperature and (relative) humidity. By controlling a high (e.g. >70% RH) humidity, evaporation of ink during transport of the printed print substrate is prevented or at least reduced.

The drying/fixation module 20 comprises a transporting mechanism 21, in this case a drum (rotating e.g. in a clock-wise direction, not shown), but could also be a transport belt or transport, rollers and a drying/fixation mechanism 22, for example comprising (radiation) heaters and air impingement modules. The printed print substrate leaves the drying/fixation module as indicated with arrow D. The printed print substrate may be further transported to a receiving tray, a post processing module (e.g. a folding module, a booklet making module or the like) or the printed print substrate may be turned and reintroduced in the image formation module 1 for duplex printing.

The transporting mechanism 3 in the image formation module 1, the transporting mechanism 11 in the transport module 10, and the transporting mechanism 21 in the drying/fixation module 20 may also comprise one or more drums, one or more transport belts, one or more transport rollers or a combination of each.

Methods for controlling the environmental conditions in the modules are known in the art and are not further discussed here.

It is noted that the embodiment shown in FIG. 1 is not limiting the scope of the present invention. The invention may for example also be implemented in a continuous feed printer using an ink jet printing technique. Also duplex media transport paths may be implemented, which are not shown in FIG. 1.

Examples

Materials

The print media used in the EXAMPLES are:

Hello Matt 115 gsm obtained from Buhrmann Ubbens;

Terraprint Silk 80 gsm obtained from Stora Enso;

Omnigloss 115 gsm obtained from Igepa; and

Digifinesse Premium Silk 90 gsm obtained from UPM.

The ink used in the examples was: Océ's iQuarius cyan ink.

Experimental Method

Figure 2:
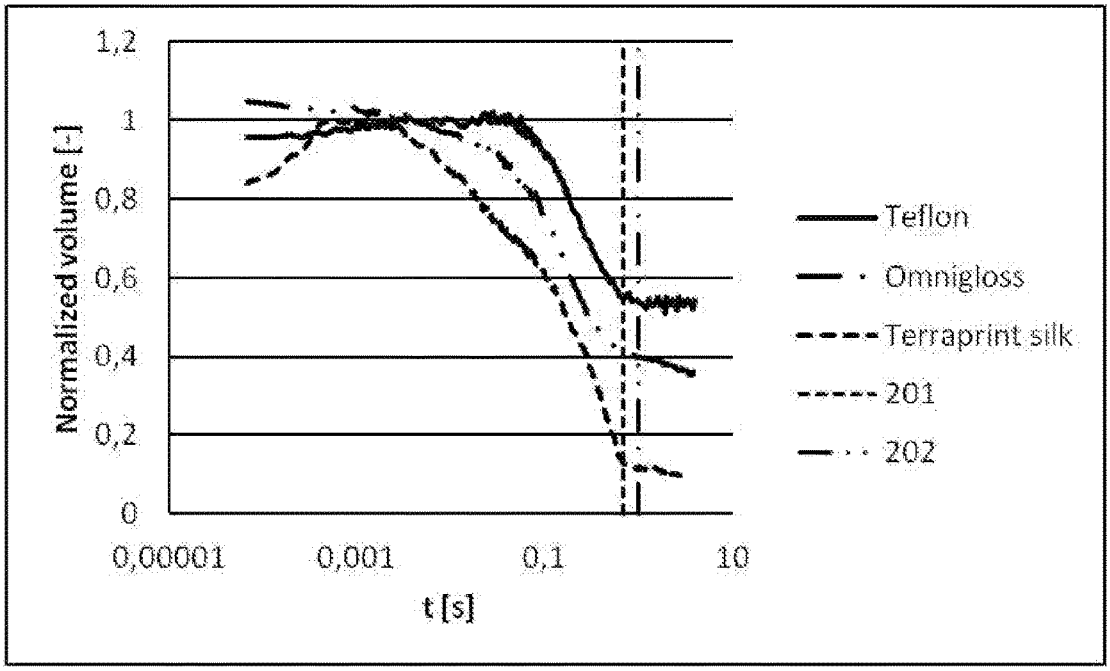
FIG. 2 is a graph representing the normalized drop volume of an ink droplet on various print media as a function of time (i.e. log(t))
Figure 3:
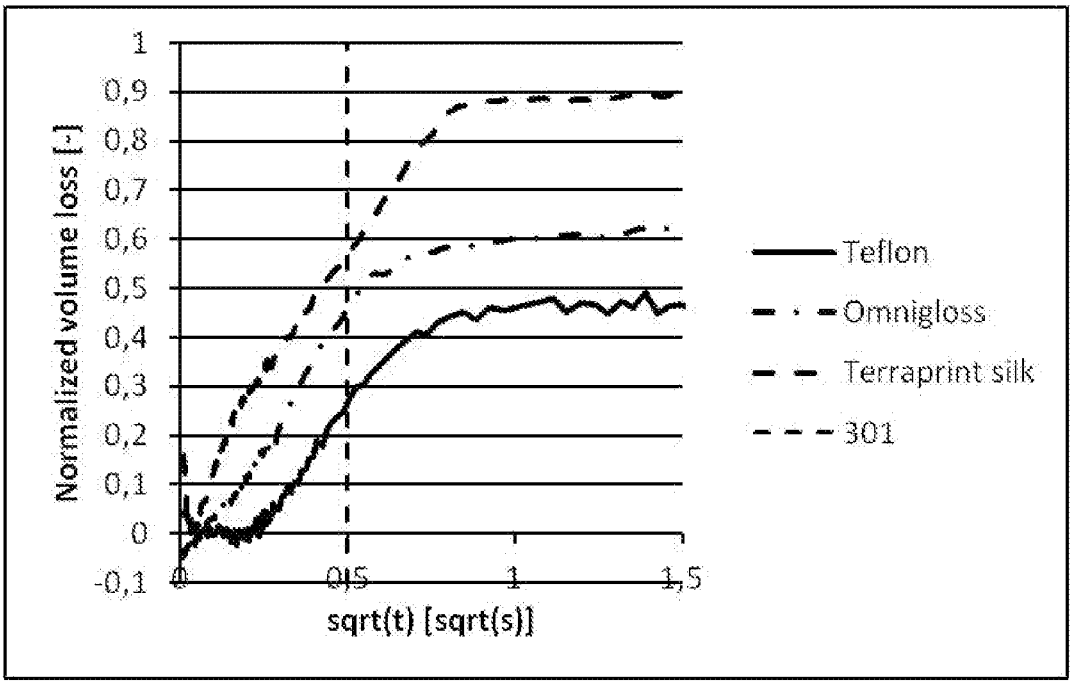
FIG. 3 is a graph representing the normalized volume loss of an ink droplet on various print media as a function of time (i.e. sqrt(t))

The absorption/evaporation ratio of ink-jet droplets was determined by analyzing high speed camera movies of drying ink-jet drops of ~15 pL on various media. The high-speed camera movies were made of ink droplets on the surface of a print substrate (media) at room temperature and the relative humidity was not controlled and was not constant for all experiments. The volume of the droplet at time t is determined by detecting the edge of the drops (2D view), fitting a circular segment through the found contour, and assuming that the shape of the droplet on the print substrate is a spherical cap. The volume of the droplet can then be calculated with: $V_{droplet}=\pi*h/6*(3a^2+h^2)$, wherein $V_{droplet}$ is the droplet volume, a is the radius of the base circle of the spherical cap (i.e. the radius of the fitted circular segment through the found contour) and h is the height of the spherical cap. The calculated volume is then normalized with respect to the volume of the jetted droplet just after impact of the droplet on the surface of the substrate (i.e. approximately after 1 ms, to eliminate or at least mitigate the effect of deformation fluctuations of the droplet just after impact on volume calculations). The normalized droplet volume is plotted as a function of time, as exemplified for a few print media in FIG. 2. It can be noted that after 700 ms a plateau value of the normalized droplet volume is obtained (indicated with line 201 in FIG. 2. The plateau value of the normalized volume is an indication for the amount of residue of ink that remains on the surface of the used print substrate. The print substrate does not absorb or hardly absorbs any ink after 700 ms, because (without wanting to be bound to any theory) the ink has become too viscous by evaporation of the less viscous components (mainly water). The ink residue on a print substrate is determined at 1 s (indicated with line 202 in FIG. 2). The volume loss on an at least partly absorbing print substrate is a combination of evaporation and absorption, the volume loss on a non-absorbing media is only due to evaporation. To determine volume loss due to evaporation, a reference experiment was performed on Teflon, a non absorbing surface. To determine normalized volume loss (i.e. volume fraction of a droplet that is lost due to a combination of evaporation and absorption) is calculated by $V_{loss}(t)=1-V_{droplet}(t)$, wherein $V_{loss}(t)$ is the normalized volume loss (fraction) at time t and $V_{droplet}(t)$ is the droplet volume at time t (see FIG. 2). Then $V_{loss}(t)$ is plotted as a function of the square root of time, see FIG. 3, and the normalized volume loss at 250 ms (sqrt(t)= 0.5 sqrt(s)) is determined, see line 301 in FIG. 3. All results are shown in Table 1.

The above disclosed procedure was performed for two media types, Terraprint silk and Omnigloss, and Teflon as a non-absorbing reference.

Then, the absorption/evaporation ratio was calculated, which is the difference in volume loss at 250 ms between a droplet on a selected print medium and a droplet on Teflon and dividing said difference by the volume loss on Teflon (evaporation only), see Table 1. The normalized residue at is 1 s plotted as a function of the absorption/evaporation ratio at 250 ms, see FIG. 4.

Figure 4:
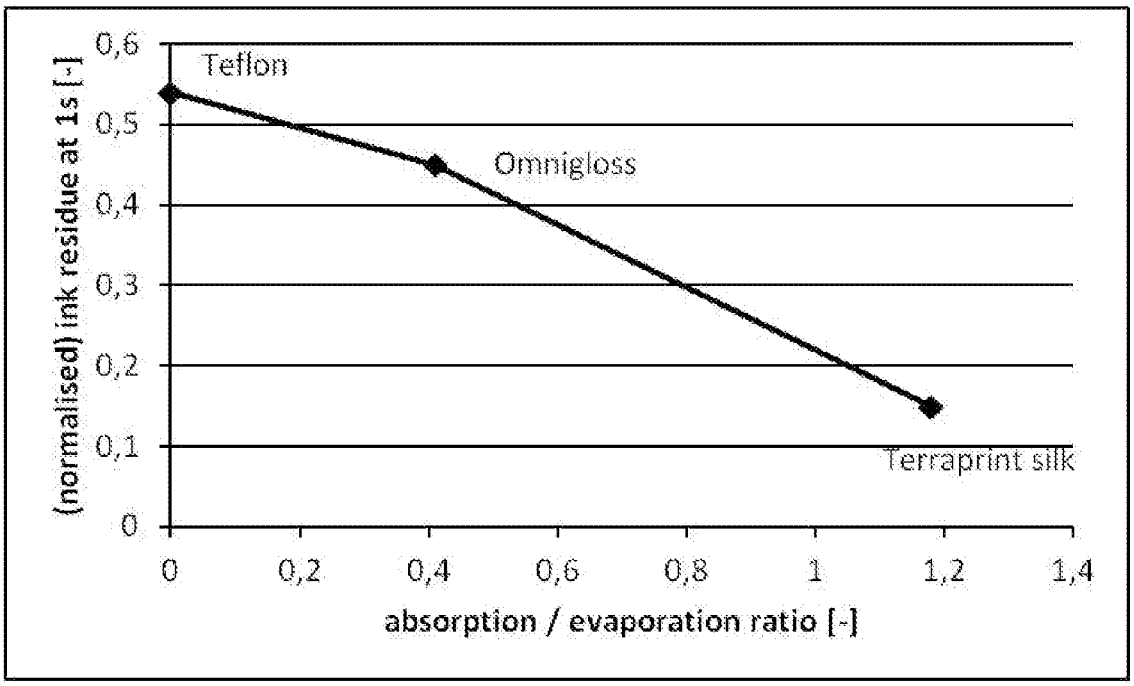
FIG. 4 is a graph representing the normalized ink residue at 1 s as a function of absorption/evaporation ratio.

Ink-media combinations having a significant absorption (i.e. high absorption/evaporation ratio, like Terraprint silk has, see Table 1, FIG. 4), achieve a small residue, and thus good print robustness. For ink-paper combinations that do not absorb well (i.e. have a relatively low absorption/evaporation ratio, like Omnigloss has, see Table 1, FIG. 4), the ink becomes too viscous after several hundred ms, and the lack of absorption in the first few hundred ms cannot be restored.

TABLE 1 experimental results absorption/evaporation

| Substrate | ink residue at 1 s (FIG. 2, 202) | volume loss at 250 ms (FIG. 2, 301) | absorption/ evaporation ratio |
|---|---|---|---|
| Teflon | 0.54 | 0.27 | 0 |
| Omnigloss | 0.45 | 0.38 | 0.41 |
| Terraprint silk | 0.15 | 0.59 | 1.18 |

The print robustness is assessed by visual inspection of a test set composed of several (simplex) test charts. The robustness scores are based on the observed damage level:

5. No damage observed in the test set;

4. The test set shows transfer of ink to the next sheet in the final stack (direct transfer from one sheet to the other sheet in a stack, related to blocking);

3. The test set shows indirect ink transfer from sheet to sheet due to engine pollution (i.e. ink transfer due to pollution of the transport wheels);

2. The test charts are damaged, the ink is still present but artifacts are visible in the print areas (i.e. impression of transport wheels); and 1. The test charts are damaged, ink is locally removed (white spots).

The above procedure was repeated for the following print media:

N20=Omnigloss 115 gsm obtained from Igepa;
N38=Top Coated Plus Silk 115 gsm obtained from Océ;
N54=Terraprint Silk 80 gsm obtained from Stora Enso;
N15=Hello Matt 115 gsm obtained from Buhrmann Ubbens;
N55=Digifinesse Gloss obtained from UPM; and
N56=Top Coated Pro Gloss 115 gsm obtained from Océ.

Figure 5:
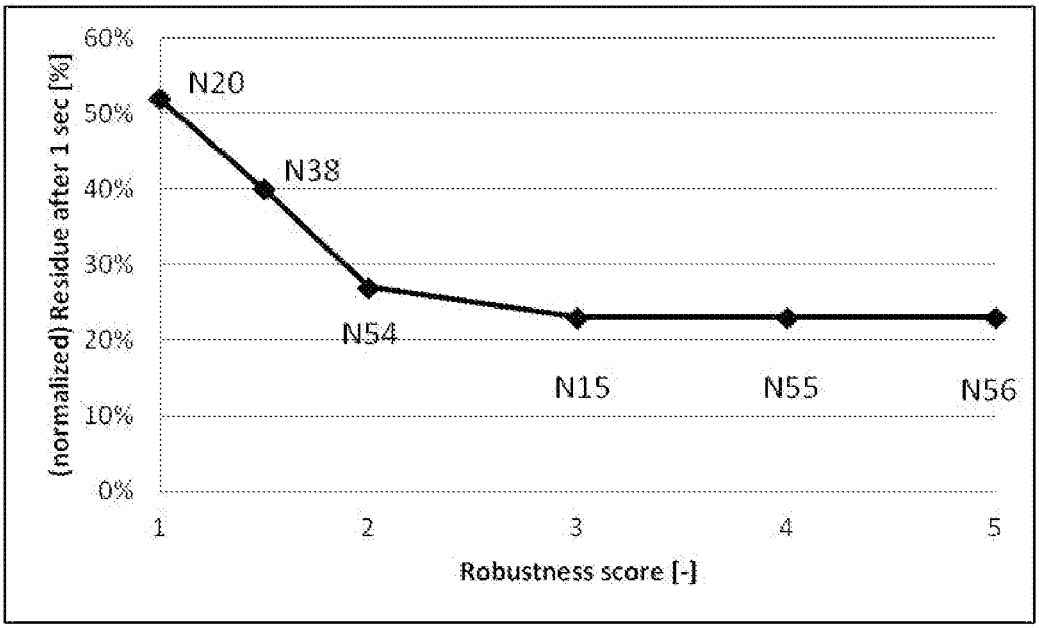
FIG. 5 is a graph representing the normalized ink residue at 1 s as a function of robustness score.

The print robustness correlates well with the residue, as shown in FIG. 5. It is noted that differences in residue for values <25% are not captured well with the high speed camera measurement method. For those values, the residue consists mainly of particles (e.g. pigment); for some cases this residue consists only of "dry" particles, for other cases there is still a lot of liquid in the voids between the particles. This can be seen visually in the camera images by the smoothness of the drop surface, but is not captured by the analysis tooling.

It can be concluded that the well absorbing print media show high print robustness.

The present invention is based on the teaching of the above experiment, in fact the experiments show that the lower the absorption/evaporation ratio is, the higher the normalized ink residue on the surface of the print medium and the lower the print robustness will be. Therefore, when during the first few hundred milliseconds, preferably 1000 ms, more preferably 2000 ms, evaporation can be reduced or even prevented, and absorption of ink components into the print substrate can be promoted, resulting in a smaller ink residue and a higher print robustness. Evaporation during said time window can be prevented by transporting the printed substrate from a print unit (where the print is made) to a drying unit (where the print is dried) through a conditioned transporting unit, in particular the Relative Humidity (RH) can be used to reduce evaporation, e.g. by controlling the RH inside the transporting unit to values above 70%.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing system, comprising:

an image formation module;

a drying/fixation module; and a transport module arranged between the image formation module and the drying/fixation module for transporting a printed print substrate from the image formation module to the drying and fixing module, wherein the transport module comprises a control system configured for controlling the relative humidity inside the transport module to at least 50%, and wherein the transport module comprises a transporting mechanism providing a transport path having a length that satisfies the following equation:

$$L \geq (v_{printing}/60 * t_{abs} * W_{image}),$$

wherein:

$v_{printing}$=the printing speed in images per minute (ipm);

$t_{abs}$=print substrate and ink set dependent absorption time (s) which is 1000 ms; and $W_{image}$=image width (m).

2. The printing system according to claim 1, wherein the control system is configured for controlling the relative humidity inside the transport module to between 50% and 100%.

3. The printing system according to claim 1, wherein the control system is configured for controlling the relative humidity inside the transport module to between 55% and 95%.

4. The printing system according to claim 1, wherein the control system is configured for controlling the relative humidity inside the transport module to between 60% and 90%.

5. The printing system according to claim 1, wherein the control system comprises a relative humidity sensor and a mechanism for increasing the relative humidity (RH).

6. The printing system according to claim 1, wherein the transporting mechanism comprises at least one transporting mechanism selected from the group consisting of a transport belt, a transport roller and a transport drum.

7. The printing system according to claim 1, wherein the length of the transport path is equal to or larger than 2.1 m.

8. A method of printing for improving ink absorption into a printed print substrate by preventing evaporation, the method comprising the steps of:

printing an image on a print substrate;

transporting the printed print substrate obtained in said step of printing; and drying and/or fixating the image on the printed print substrate, wherein said step of transporting is performed in a conditioned environment having a relative humidity controlled to at least 50%, and wherein the transport module comprises a transporting mechanism providing a transport path having a length that satisfies the following equation:

$$L \geq (v_{printing}/60 * t_{abs} * W_{image}),$$

wherein:

$v_{printing}$=the printing speed in images per minute (ipm);

$t_{abs}$=print substrate and ink set dependent absorption time (s) which is 1000 ms; and $W_{image}$=image width (m).

9. The method of printing according to claim 8, wherein the relative humidity in said transporting step is controlled to at least 70%.

* * * * *